US009957138B2

(12) United States Patent
Schorn et al.

(10) Patent No.: US 9,957,138 B2
(45) Date of Patent: May 1, 2018

(54) DEVICE AND METHOD FOR LIFTING CIRCULAR STRUCTURES

(71) Applicant: Tom Schorn, Canton, SD (US)

(72) Inventors: Tom Schorn, Canton, SD (US); Perry Henry Mayland, Assumption, IL (US); Susan NaDean Wise, Assumption, IL (US)

( * ) Notice: Subject to any disclaimer, the term of this patent is extended or adjusted under 35 U.S.C. 154(b) by 0 days. days.

(21) Appl. No.: 15/234,831

(22) Filed: Aug. 11, 2016

(65) Prior Publication Data

US 2018/0044142 A1 Feb. 15, 2018

(51) Int. Cl.
*B66C 1/16* (2006.01)
*B66C 1/66* (2006.01)

(52) U.S. Cl.
CPC . *B66C 1/16* (2013.01); *B66C 1/66* (2013.01)

(58) Field of Classification Search
CPC ..... B66C 1/16; B66C 1/66
USPC ..... 294/74, 81.1, 81.5, 119.2, 81.4, 113
See application file for complete search history.

(56) References Cited

U.S. PATENT DOCUMENTS 288,853 A * 11/1883 Poage ..... A47F 5/0823 211/115
819,576 A * 5/1906 McCabe ..... B66C 1/18 294/74
1,932,527 A * 10/1933 Long ..... B01D 11/0269 210/237
2,825,598 A * 3/1958 Nickolai ..... B66C 1/12 294/75
3,210,114 A * 10/1965 Lawton ..... B66C 13/08 294/81.4
4,009,898 A * 3/1977 Hampton ..... B66C 1/625 294/119.2
4,032,102 A * 6/1977 Wolf ..... A47G 7/047 248/301
D250,376 S * 11/1978 Schoenbrun ..... 47/67
4,592,581 A * 6/1986 Howard ..... B25J 15/10 294/111
5,549,342 A * 8/1996 Donaldson ..... B66C 1/127 294/68.1
5,641,189 A * 6/1997 Landman ..... B66C 1/18 294/74
6,543,826 B1 * 4/2003 Aston ..... B66C 1/18 294/119.2
6,991,196 B2 * 1/2006 Wheeler ..... B65H 49/22 242/129
7,032,347 B2 * 4/2006 Hartman ..... A47G 7/047 47/67

(Continued)

*Primary Examiner* — Paul T Chin
(74) *Attorney, Agent, or Firm* — Etherton Law Group, LLC

(57) ABSTRACT

A device and method for lifting cylindrical structures using an overhead crane. The device comprises a lift cap with a lift tab that is the single-point of connection to the crane. The lift cap has a plurality of slots around its perimeter. A plurality of spreader straps are connected to the lift cap at the slots with shackles that permit the straps to slide a limited distance in the slots. The spreader straps hang down from the lift cap and connect it to a lift ring that hangs below the lift cap. The lift ring is comprised of a series of connected spreader bars and is about the same diameter as the grain bin. Slings attached to the spreader bars hang below the lift ring. The loose end of each sling is removably attached to the cylindrical structure.

8 Claims, 9 Drawing Sheets

(56) References Cited

U.S. PATENT DOCUMENTS

| | | | | |
|---|---|---|---|---|
| 7,905,527 | B1 * | 3/2011 | Smallin | B66C 1/16 294/66.1 |
| 9,546,079 | B1 * | 1/2017 | Mercier | B66C 1/625 |
| 2013/0099515 | A1 * | 4/2013 | Guerrero | B66C 1/442 294/67.1 |

* cited by examiner

DEVICE AND METHOD FOR LIFTING CIRCULAR STRUCTURES

FIELD OF INVENTION

This invention relates generally to load-engaging elements for cranes. This invention relates particularly to a below-the-hook device and method for lifting circular structures, such as an assembled grain bin, using a crane.

BACKGROUND

Grain bins typically have cylindrical steel walls and conical steel roofs and are assembled on-site. The cylindrical steel wall is fashioned from curved steel panels having horizontal corrugations. Bolt holes are located about the edges of the curved steel panels so that panels can be fastened to the lower edge of an assembled roof and to each other in successive rings to complete a bin. To build a bin a circular roof is placed on the ground where the bin is to be located. The roof is lifted it off the ground with the use of jacks spaced around the circumference of the roof, and a first ring of wall panels is attached to the lower edge of the roof. To avoid over-stressing the wall panels, all the jacks must be operated in small increments or preferably simultaneously. Once connected, the roof and first ring are lifted again with the jacks and a second ring is attached to the lower edge of the first ring. The structure continues to be lifted and successive rings of panels added until the bin reaches the desired height.

This current method is difficult and labor intensive. One of the most difficult parts of bin construction is raising the successive circular rings of panels so that all parts of the structure stay level and lift at the same rate. If this is not done properly, parts of the structure will be overloaded and the structure will collapse.

Another method for building a grain bin includes the use of an overhead crane. This method is difficult because a single point suspension of a large grain bin, at the point of the conical roof, is unstable. A multi-point suspension of a large grain bin is subject to the same difficulties as a multi-point jacking operation: it's difficult to keep all parts of the structure level and to lift them at the same rate.

A related construction problem arises when building hoppers. Hoppers are grain bins with v-shaped conical bottoms for dispensing the grain into other containers using gravity. It would be desirable to build the conical bottom in place and then place add the circular steel rings and conical roof on top of it.

There is a need to provide a stable method of constructing a grain bin that is easier and less labor intensive than current methods.

SUMMARY OF THE INVENTION

This invention is a device and method for lifting cylindrical structures using an overhead crane. The device comprises a lift cap with a lift tab that is the single-point of connection to the crane. The lift cap has a plurality of slots around its perimeter. A plurality of spreader straps are connected to the lift cap at the slots with shackles that permit the straps to slide a limited distance in the slots. The spreader straps hang down from the lift cap and connect it to a lift ring that hangs below the lift cap. The lift ring is comprised of a series of connected spreader bars and is about the same diameter as the grain bin. Slings attached to the spreader bars hang below the lift ring. The loose end of each sling is removably attached to the bin.

To move a grain bin, the device is lifted with a crane and suspended over the bin, with the lift cap centered over the approximate center of the roof of the bin. Each sling is attached to the bin in a spaced formation. The crane slowly lifts the device using the lift tab until the slings start to tighten as they support the weight of the bin. As the crane slowly lifts the device, the bin is lifted off the ground and the weight is distributed around the lift ring by gravity as the spreader straps move in the slots. With the proper number of spreader bars and slings relative to the size of the bin, an assembled bin can be lifted off the ground and moved to a desired location. Once in place it can be secured to the ground or, if building a hopper, to the conical bottom.

DETAILED DESCRIPTION OF THE INVENTION

Figure 1:
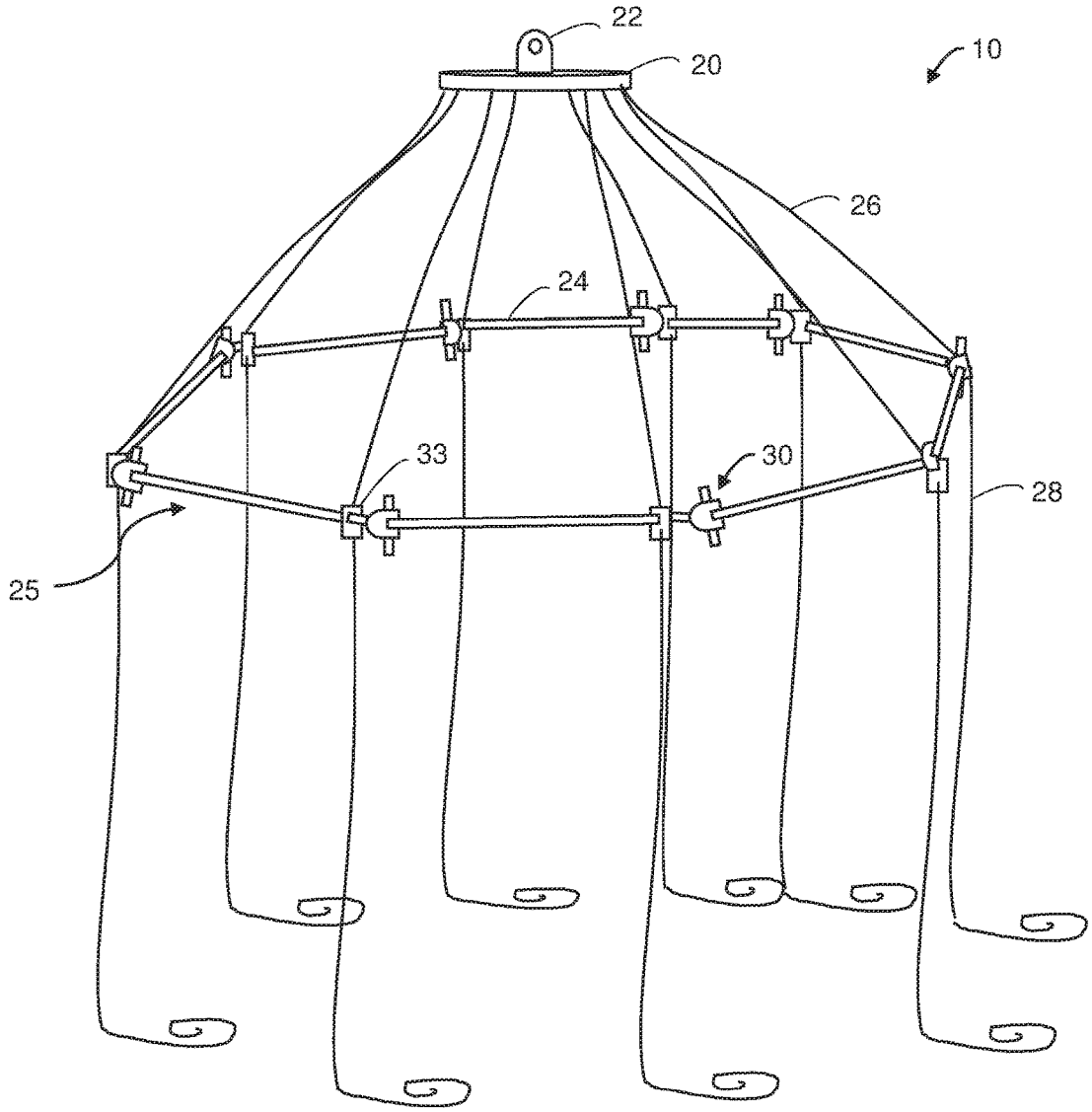
FIG. 1 is a perspective view of the device as if suspended from a crane near the ground so that the slings rest on the ground. The crane is not shown.

FIG. 1. illustrates a below-the-hook device 10 that enables an overhead crane to stably engage and lift an item having a circular cross-section, such as a grain bin 9, water tank, oil tank, chemical tank, or other round or cylindrical structure. A grain bin 9 will be used as the exemplary case herein, but the device may be used on any round or cylindrical structure.

Figure 2:
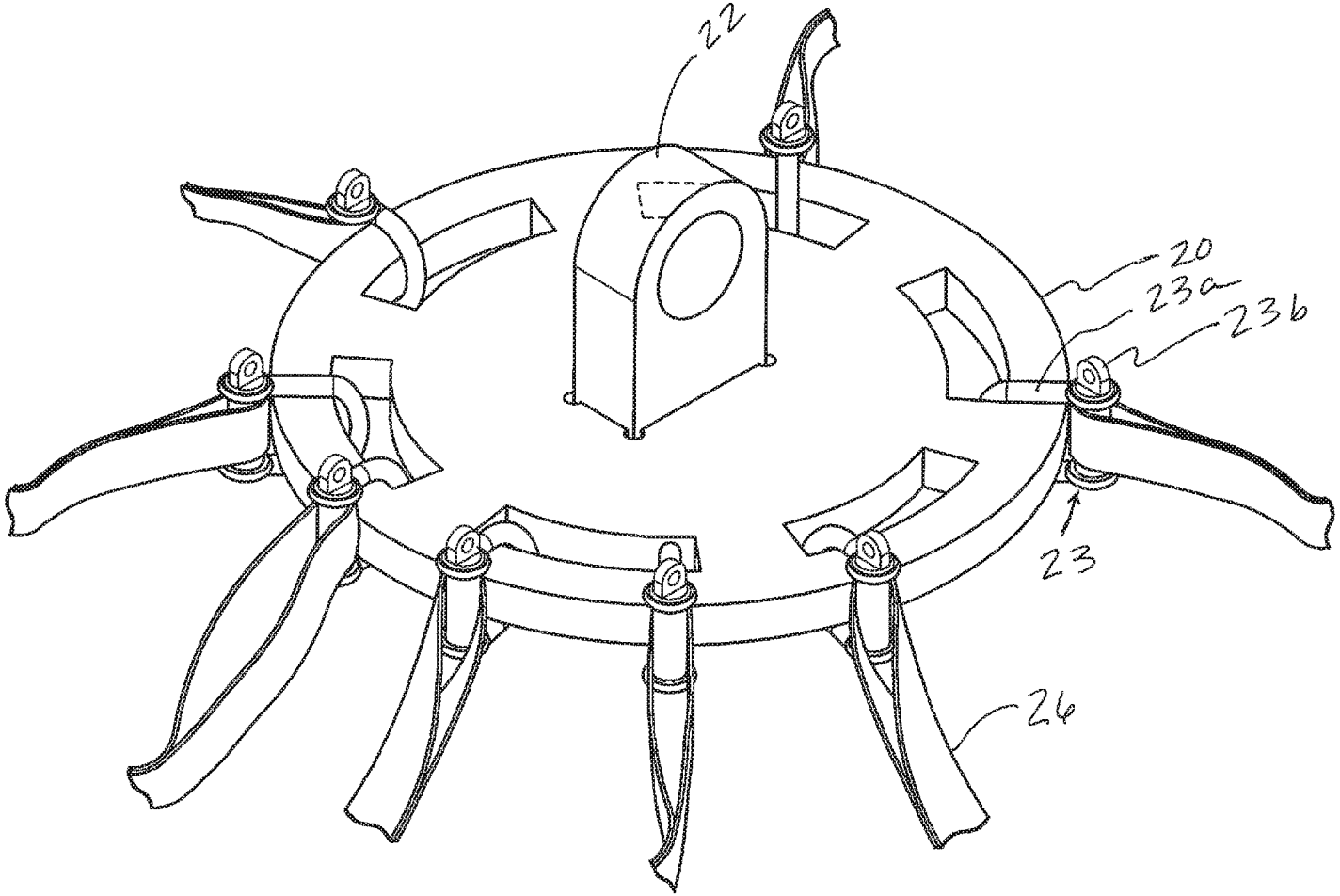
FIG. 2 is a perspective view of the lift cap and attached spreader straps.
Figure 3:
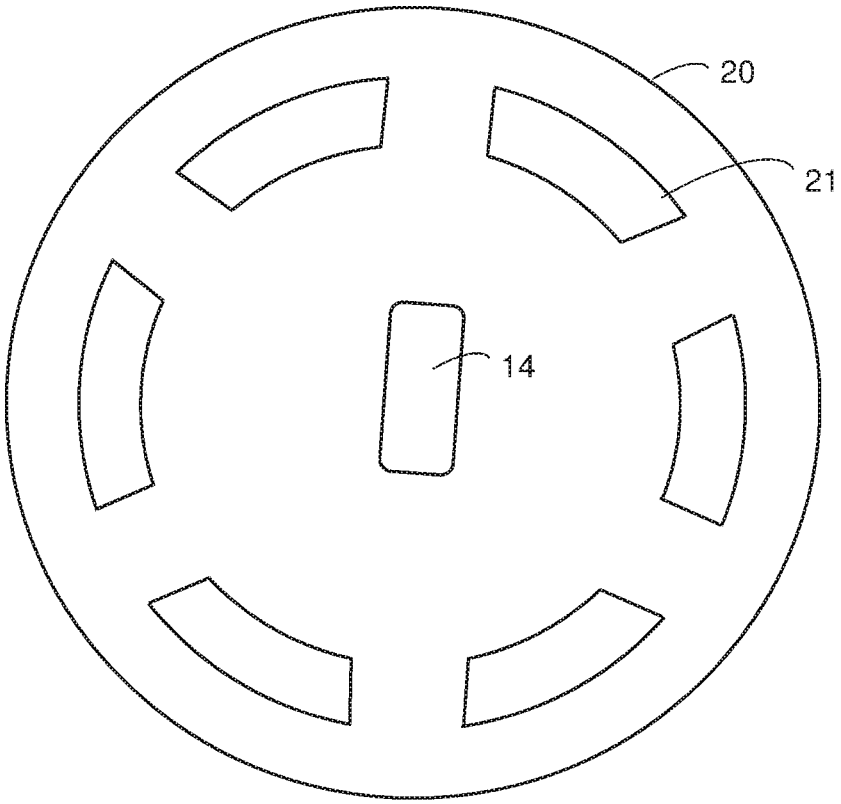
FIG. 3 is a top view of the lift cap without the tab inserted.
Figure 9:
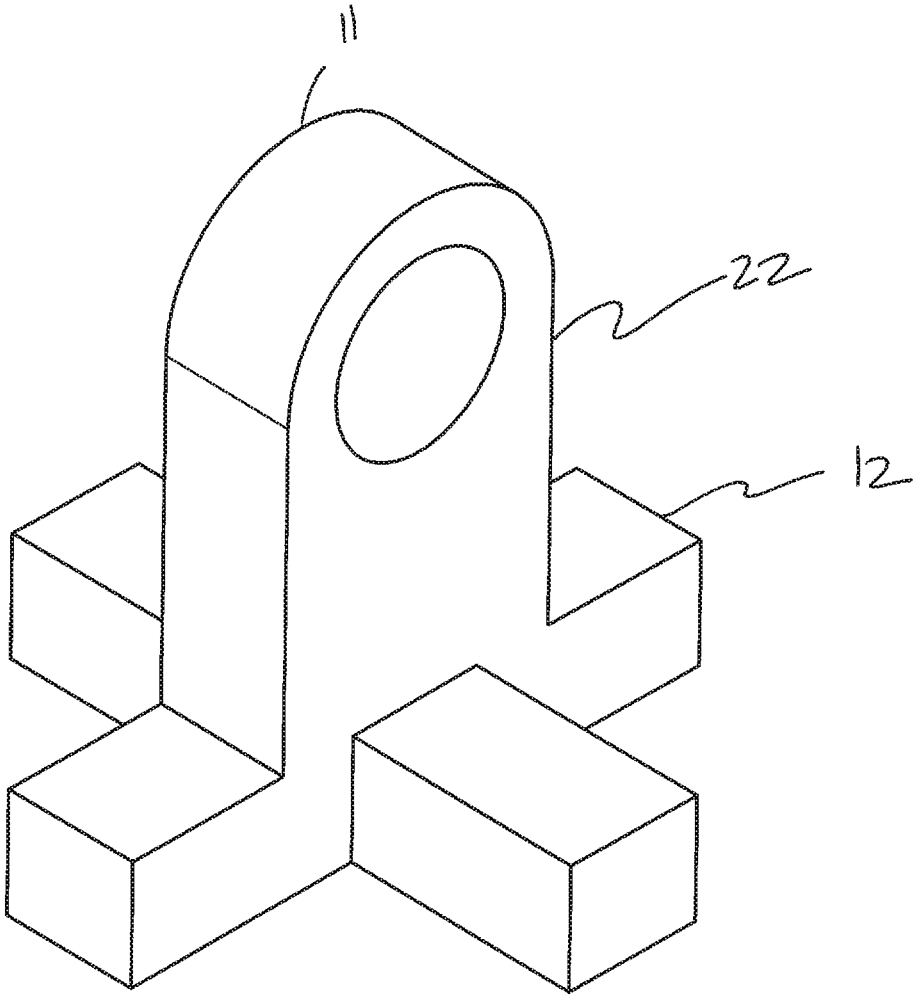
FIG. 9 is a perspective view of a lift tab.

The device comprises a lift cap 20 with a lift tab 22 extending upwards perpendicular to the lift cap. FIGS. 2 and 3 illustrate the lift cap 20 in detail. The lift cap 20 is also known in the industry as a star. The lift tab 22 is the single-point of connection to the crane 50. In a preferred embodiment the lift tab 22 is a T-shaped component comprising the tongue 11 and four legs 12. See FIG. 9. The tongue 11 is inserted through a tab slot 14 so that, in operation, the legs 12 support the weight of the lift cap and its load while allowing some movement between the legs 12 and the lift cap. Typically the crane will use a hook (not shown) to engage the lift tab. Optionally cut-outs are used to reduce the weight of the lift cap 20.

The lift cap 20 is circular and has a plurality of slots 21 spaced around its perimeter for engaging spreader straps 26. In a preferred embodiment there are six slots, each engaging one or more spreader straps 26. The top end of each spreader strap 26 is movably connected to the lift cap 20 at a slot 21, preferably using a clevis fastener 23. The outer perimeter of the lift cap 20 fits somewhat loosely in the shackle 23*a* and the clevis pin 23*b* closes the clevis 23 thus retaining the clevis 23 on the lift cap. The shackle 23*a* rides loosely in the slot 21, allowing it to have three dimensions of movement.

In this manner each spreader strap 26 can slide around a portion of the perimeter of the lift cap 20 at varying angles. The ends of each slot 21 act as a limit on how far each spreader strap 26 can slide.

Figure 4:
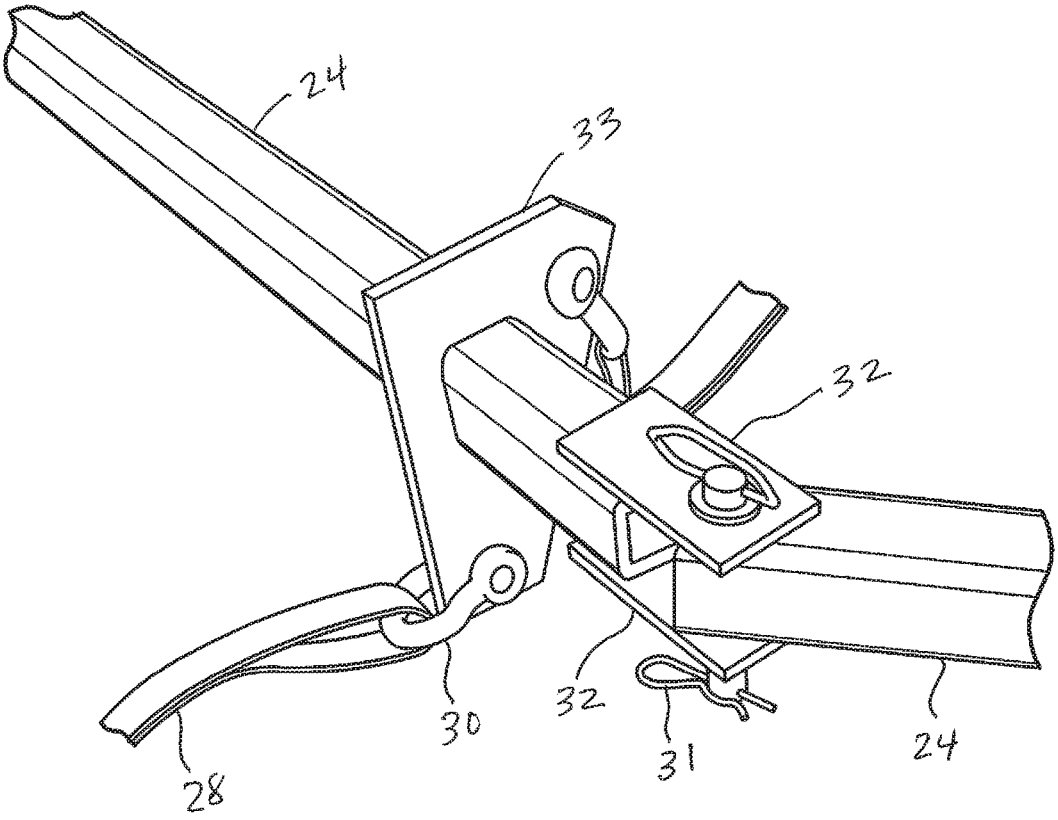
FIG. 4 is a perspective view of the hitch pin connecting two spreader bars.

A plurality of spreader straps 26 hang down from the lift cap 20 and connect it to a lift ring 25 that hangs below the lift cap. See FIG. 1. The lift ring 25 is comprised of a plurality of connected spreader bars 24. The spreader bars 24 are rigid and are of sufficient number to form a circle having a diameter that is about the same as that of the circular structure being lifted. The number and length of the spreader bars depends on the desired diameter and flexibility of the left ring. More spreader bars 24 are used for larger diameter or more flexible devices; fewer spreader bars 24 are used for smaller diameter or less flexible devices. A hinge connects the first end of each spreader bar 24 to the second end of the next spreader bar 24 to form a segmented circle that flexes at the hinges. Preferably the hinge is a hitch pin 30 secured with a cotter pin 31 through opposing apertures on the ends of the spreader bars 24. Extension plates 32 on the spreader bars 24 enable the ends of the spreader bars to rotate freely around the hitch pin 30 without interfering with each other. See FIG. 4.

Figure 7:
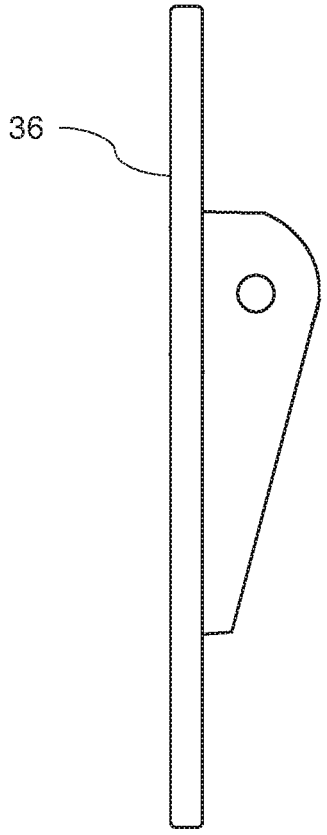
FIG. 7 is a side view of a lift bracket.
Figure 8:
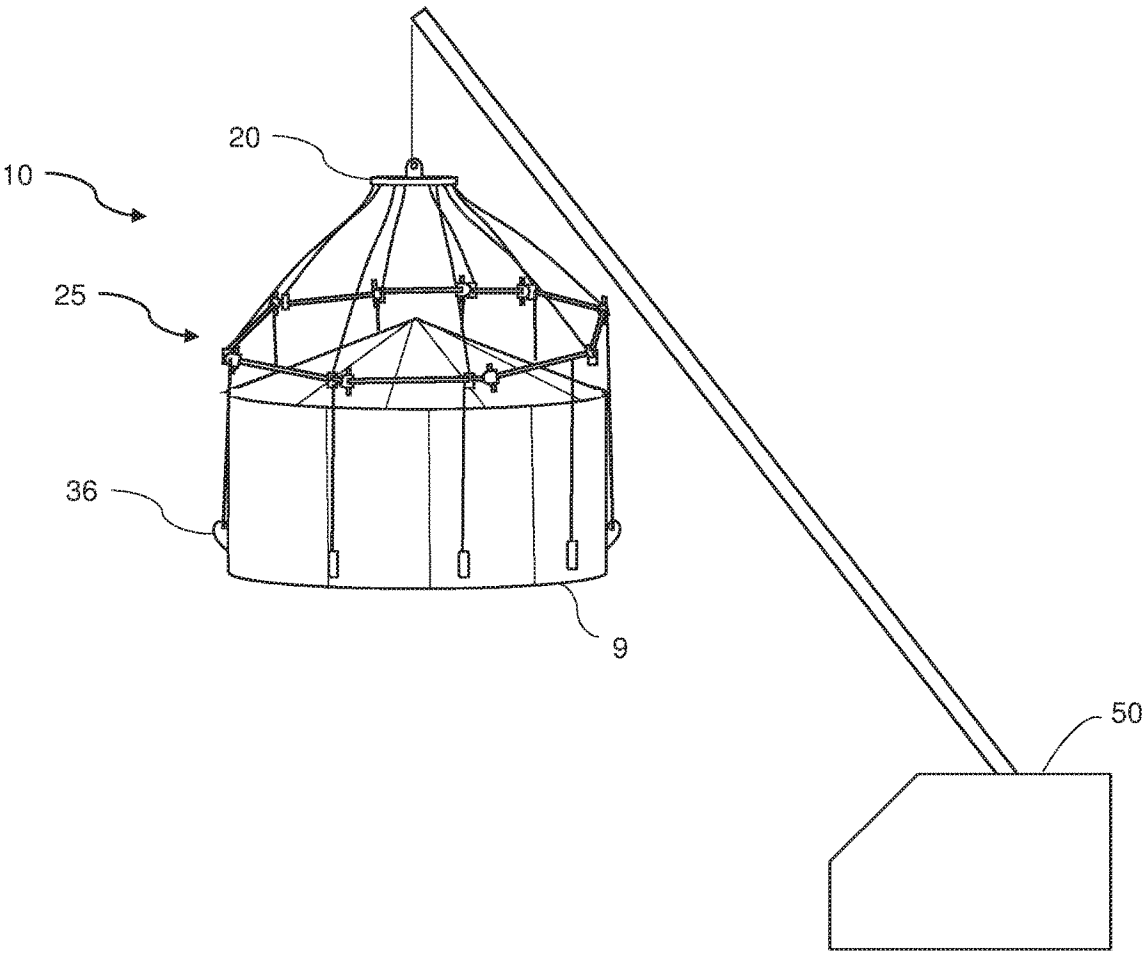
FIG. 8 illustrates a grain bin with lift brackets suspended in the air using the device.

Slings 28 are attached to the spreader bars 24 to hang below the lift ring 25. See FIG. 1. Slings 28 are preferably made of webbed lifting material, but may also be made of wire rope, chain or other material, depending on the needs of the specific application. One end of each sling 28 connects to a spreader bar 24 and the opposite, or loose, end of each sling 28 removably connects to the side of the circular structure. The type and location of connection depends in part on the type of structure being moved. FIG. 7 shows one version of a lift bracket 36 to be mounted on the side of a grain bin 9 with bolts inserted through the bin and secured with nuts. A sling 28 is removably connected to the lift bracket 36 at the lift aperture. FIG. 8 shows lift brackets 36 spaced around the bin and slings attached. In the exemplary embodiment used with a circular steel grain bin made of rings of steel wall panels, the lift brackets 36 are mounted on the second ring from the bottom of the bin. This allows the bottom ring to hang loose so that it is easier to align and attach the bottom ring to the bin foundation at the installation site. In other embodiments the loose end of each sling 28 connected to the round structure with eyebolts, hooks, or even at apertures in the structure.

A spreader strap 26 and a sling 28 are connected to the same end of a spreader bar 24 at a frame plate 34 that is attached parallel to the cross section of the spreader bar 24. See FIG. 4. Preferably each spreader strap 26 and sling 28 is attached to the frame plate 33 using a clevis fastener 23 inserted through apertures in the frame plate 33. In this manner the straps have vertical movement, limited by the interference of the shackle and the frame plate. That is, as the shackle 23*a* rotates around the clevis pin 23*b* the strap can move up and down until the shackle 23*a* abuts the frame plate 33.

Spreader straps 26 and slings 28 are preferably made of webbed lifting material, such as woven nylon, but may be made of polypropylene, polyester or other material depending on the weight capacity, elasticity, and other desired characteristics. Spreader straps 26 and slings 28 may also be made of wire rope, chain or other material, depending on the needs of the specific application.

Figure 5:
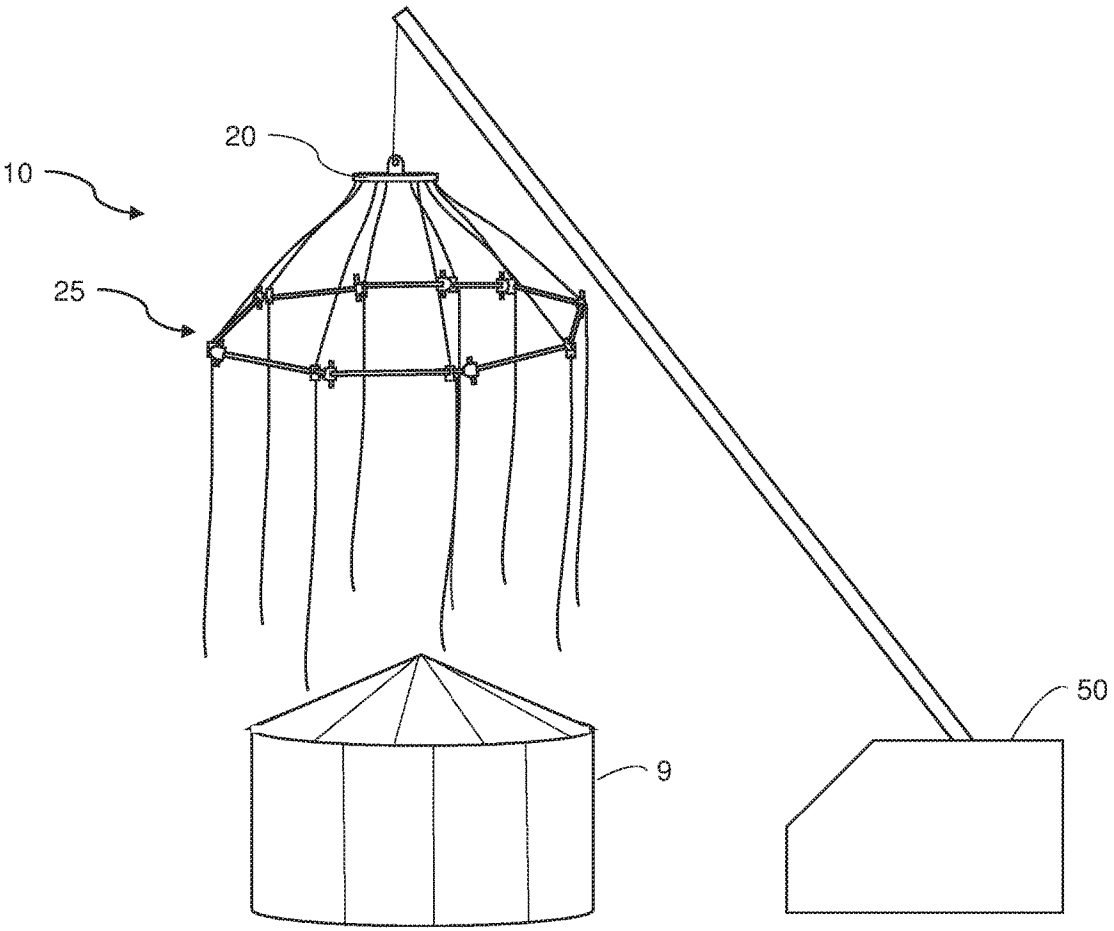
FIG. 5 illustrates a device suspended by a crane over an assembled grain bin.
Figure 6:
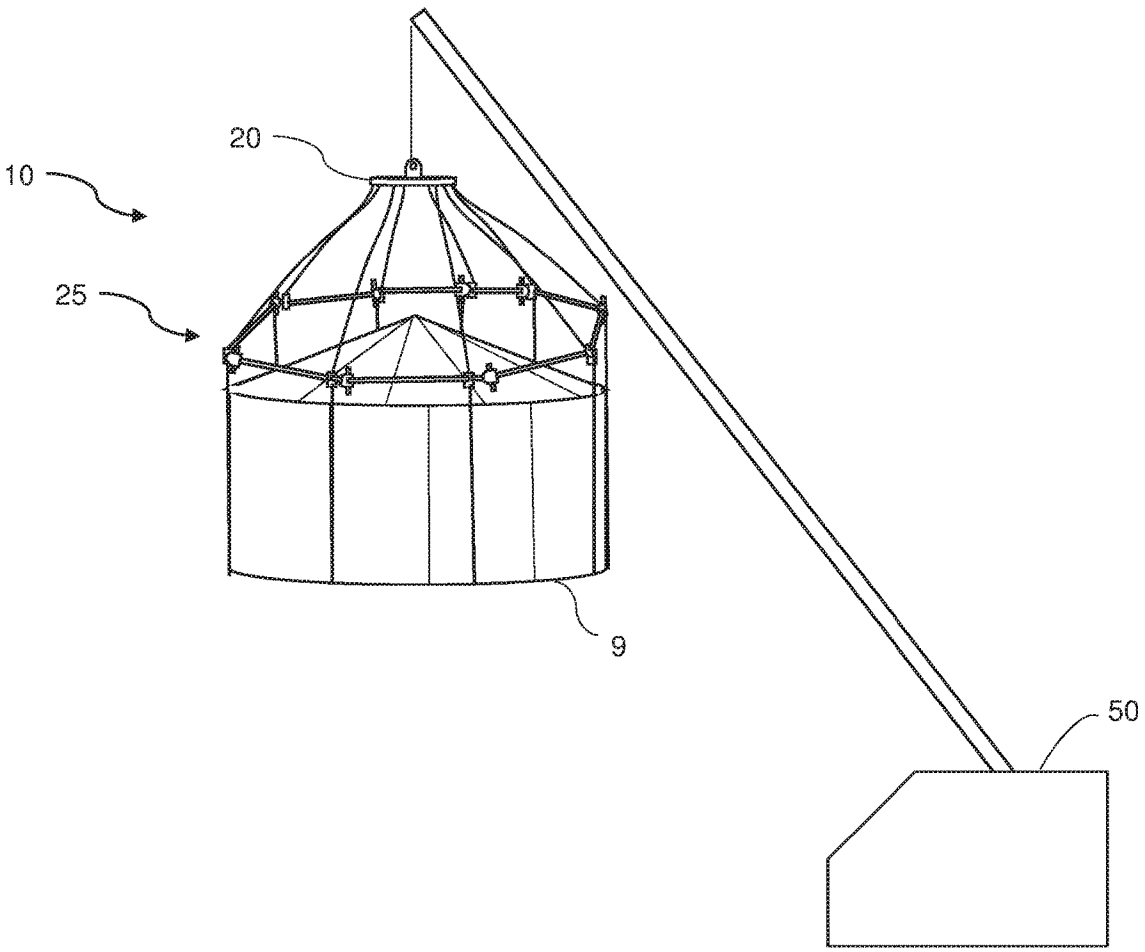
FIG. 6 illustrates a grain bin suspended in the air using the device.

To move the bin 9, a crane engages the lift tab 22 with its hook and lifts the device 10, suspending it over the bin 9 with the lift cap 20 roughly centered over the apex of the roof of the bin. See FIG. 5. Each sling 28 is attached to the bin 9 in a spaced formation. The crane 50 slowly lifts the device 10 until the spreader straps 26 and slings 28 start to tighten as they are loaded with the weight of the bin. The crane continues to slowly lift the device. As it does, the bin 9 is lifted off the ground and the weight of the bin is distributed by the force of gravity around the lift ring 25, as the spreader straps 26 move in the slots 21. See FIG. 6.

With the proper number of spreader bars and slings relative to the size of the bin, an assembled bin can be lifted off the ground and stably moved to a desired location. Once in place it can be secured to the ground or other structure, for example to the conical bottom if building a hopper, While there has been illustrated and described what is at present considered to be the preferred embodiment of the present invention, it will be understood by those skilled in the art that various changes and modifications may be made and equivalents may be substituted for elements thereof without departing from the true scope of the invention. Therefore, it is intended that this invention not be limited to the particular embodiment disclosed, but that the invention will include all embodiments falling within the scope of the appended claims.

What is claimed is:

1. A device for lifting a circular structure, the device comprising:

a. a lift cap;

b. a plurality of spreader straps connected to the lift cap;

c. a lift ring connected to the spreader straps, wherein the lift ring comprises two or more separable segments and wherein the lift ring comprises a plurality of spreader bars, each of which is flexibly connected to another spreader bar; and d. a plurality of slings connected to the lift ring and connectable to the circular structure.

2. The device of claim 1 further comprising a hinge connecting each spreader bar to another.

3. A device for lifting a cylindrical structure with a crane comprising:

a. a lift tab;

b. a lift cap connected to the lift tab;

c. a plurality of spreader straps each having a top end and a bottom end, wherein each spreader strap is moveably attached at its top end to the lift cap;

d. a plurality of spreader bars each having a first end and a second end, wherein the first end of a spreader bar is attached to the bottom end of a spreader strap;

e. a plurality of hinges connecting the first end of each spreader bar to the second end of the next spreader bar to form a circle; and f. a plurality of slings, each having a spreader bar end and a bin end, wherein the spreader bar end of each strap is attached to the spreader bar and the bin end is attachable to the cylindrical structure.

4. The device of claim 3 wherein the lift cap is circular and has a plurality of slots around its perimeter for receiving the top ends of the plurality of spreader straps.

5. The device of claim 3 wherein each spreader strap is attached to the lift cap with a clevis in one of the slots such that the spreader strap is free to slide around at least a portion of the perimeter.

6. The device of claim 3 wherein the first end of each spreader bar comprises two opposing apertures, the second end of each spreader bar comprises two opposing apertures, and the hinge comprises attaching the first end of each spreader bar to the second end of the next spreader bar by aligning the apertures of the first end with the apertures of the next bar's second end and inserting a pin therethrough.

7. The device of claim 3 wherein the slings are removably attachable to the circular structure.

8. The device of claim 3 wherein each of the plurality of slings are removably attachable to the circular structure with a bracket.

* * * * *